US007464705B2

(12) United States Patent
Tanizawa et al.

(10) Patent No.: US 7,464,705 B2
(45) Date of Patent: Dec. 16, 2008

(54) POWERED RESPIRATOR

(75) Inventors: Naoto Tanizawa, Tokyo (JP); Hiroyuki Ide, Saitama (JP); Hidetoshi Nagasawa, Saitama (JP)

(73) Assignee: Shigematsu Works Co., Ltd, Saitama (JP)

( * ) Notice: Subject to any disclaimer, the term of this patent is extended or adjusted under 35 U.S.C. 154(b) by 2 days.

(21) Appl. No.: 11/246,624

(22) Filed: Oct. 6, 2005

(65) Prior Publication Data

US 2006/0076012 A1 Apr. 13, 2006

(30) Foreign Application Priority Data

Oct. 7, 2004 (JP) ..... 2004-295357

(51) Int. Cl.
*A62B 19/00* (2006.01)
*A62B 18/00* (2006.01)
*A62B 18/10* (2006.01)

(52) U.S. Cl. ..... 128/201.25; 128/201.23; 128/201.28

(58) Field of Classification Search ..... 128/201.22, 128/201.23, 201.24, 201.25, 201.28, 201.19, 128/206.19, 206.17, 205.25, 205.24, 205.27, 128/205.29, 206.12, 206.21, 206.24, 206.28, 128/207.11, 207.12
See application file for complete search history.

(56) References Cited

U.S. PATENT DOCUMENTS 908,108 A * 12/1908 Knudsen ..... 128/200.27
2,898,908 A * 8/1959 Sovinsky ..... 128/201.15
3,540,442 A * 11/1970 Holloway ..... 128/201.19
4,373,520 A * 2/1983 Arbique ..... 128/201.19
4,718,415 A * 1/1988 Bolnberger et al. .... 128/201.19
4,915,099 A * 4/1990 Davis ..... 128/201.19
4,958,633 A * 9/1990 Angell ..... 128/201.19
5,031,237 A * 7/1991 Honrud ..... 2/8
5,224,473 A * 7/1993 Bloomfield ..... 128/201.19
5,224,474 A * 7/1993 Bloomfield ..... 128/201.19
5,372,130 A * 12/1994 Stern et al. ..... 128/205.25
5,572,990 A * 11/1996 Berlin ..... 128/201.19
6,257,235 B1 * 7/2001 Bowen ..... 128/206.21
6,382,206 B1 * 5/2002 Palazzotto et al. ..... 128/201.19
6,430,298 B1 * 8/2002 Kettl et al. ..... 381/361
6,435,184 B1 * 8/2002 Ho ..... 128/206.21
6,854,464 B2 * 2/2005 Mukaiyama et al. ... 128/206.17
2003/0066527 A1 * 4/2003 Chen ..... 128/204.18
2004/0216741 A1 * 11/2004 Arnott ..... 128/204.18

FOREIGN PATENT DOCUMENTS

JP 2003-117013 4/2003
JP 2004-016466 1/2004

* cited by examiner

*Primary Examiner*—Annette F Dixon
(74) *Attorney, Agent, or Firm*—Flynn, Thiel, Boutell & Tanis, P.C.

(57) ABSTRACT

A powered respiration comprising, an air supplying unit and a filter equipped to a face piece part of said powered respiration, wherein an electric fan, a motor and a battery are installed in said air supplying unit.

16 Claims, 3 Drawing Sheets

POWERED RESPIRATOR

FIELD OF THE INVENTION

Figure 1:
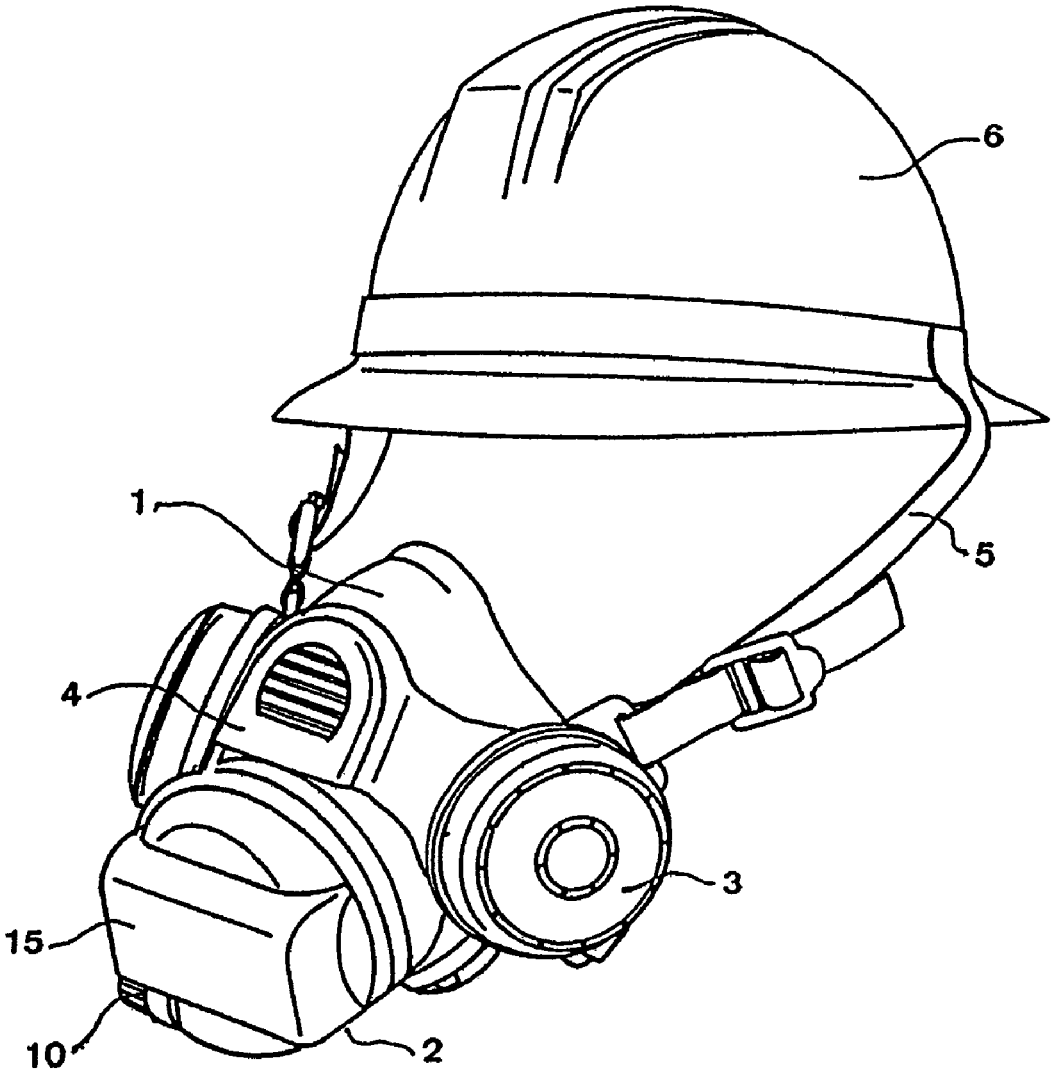

The present invention relates to a powered respirator with an electric fan which can be used as a dust proof mask or a gas mask at a place where dust or poisonous gas are generated such as factory, construction field or tunnel construction field.

BACKGROUND OF THE INVENTION

In general, said kind of powered respirator with an electric fan is comprising of a face piece part that covers at least nose and mouth of a user, an electric fan, a motor which drives the electric fan and a filter and has a structural feature characterizing that clean air from which fine particles drifting in atmosphere are removed by means of the electric fan and the filter to a face of the user. For the above purpose, an air line hose to supply clean air or an electric source cable to transmit electricity to the motor are equipped to the conventional powered respirator, therefore a user who wear the conventional powered respirator feels inconveniences while at work. In particular, in a case of tunnel construction field, a powered respirator equipped with an electric source cable can not be used in a working face where an explosive such as dynamite is used from the safety view point, therefore, a powered respirator without an electric source cable is needed in a working face.

To improve above mentioned problem, various kinds of respirator are proposed, for example, in Patent Document 1, a respirator with an electric fan unit to which a filter and an electric fan are equipped is disclosed. However, this respirator is necessary to provide electric source cables to transmit electricity to electric fan units locating right and left positions from a battery. Further, in Patent Document 2, a powered respirator characterizing, containing a fan unit installing an electric fan in a main body of casing, a filter is equipped to the main body of casing at up stream side to a suction opening of the fan unit, exiting a cylindrical duct between the suction opening of the fan unit and the filter in the main body of casing, and press adhering one end of duct with the suction opening of the fan unit and another end of duct with the filter is disclosed.

Patent Document 1: JP Laid open publication 2003-117013

Patent Document 2: JP Laid open publication 2004-16466

OBJECT OF THE INVENTION

The inventors of the present invention have earnestly investigated about a respirator of simple structure, easy wearing for a user and promises easy working for the user even if the user is wearing the respirator, and accomplished the present invention. That is, the object of the present invention is to provide a respirator of simple structure and easy wearing.

DISCLOSURE OF THE INVENTION

The important point of the present invention is a respirator comprising an air supplying unit and a filter at a face piece part, wherein an electric fan, a motor and a battery are built in to said air supplying unit.

Effect of the Invention

Since the respirator of the present invention is characterized that an electric fan, a motor and a battery are built in by forming one body in an air supplying unit, it has advantageous that it is not necessary to equip an electric source cable or an air supplying tube which are necessary parts of a conventional powered respirator, further, structure is simple and easy wearing for a user, and promises easy working for a user even if the user is wearing the respirator.

BRIEF ILLUSTRATION OF DRAWINGS

FIG. 1: Perspective view showing the state that the powered respirator of the present invention is worn together with a helmet.

Figure 2:
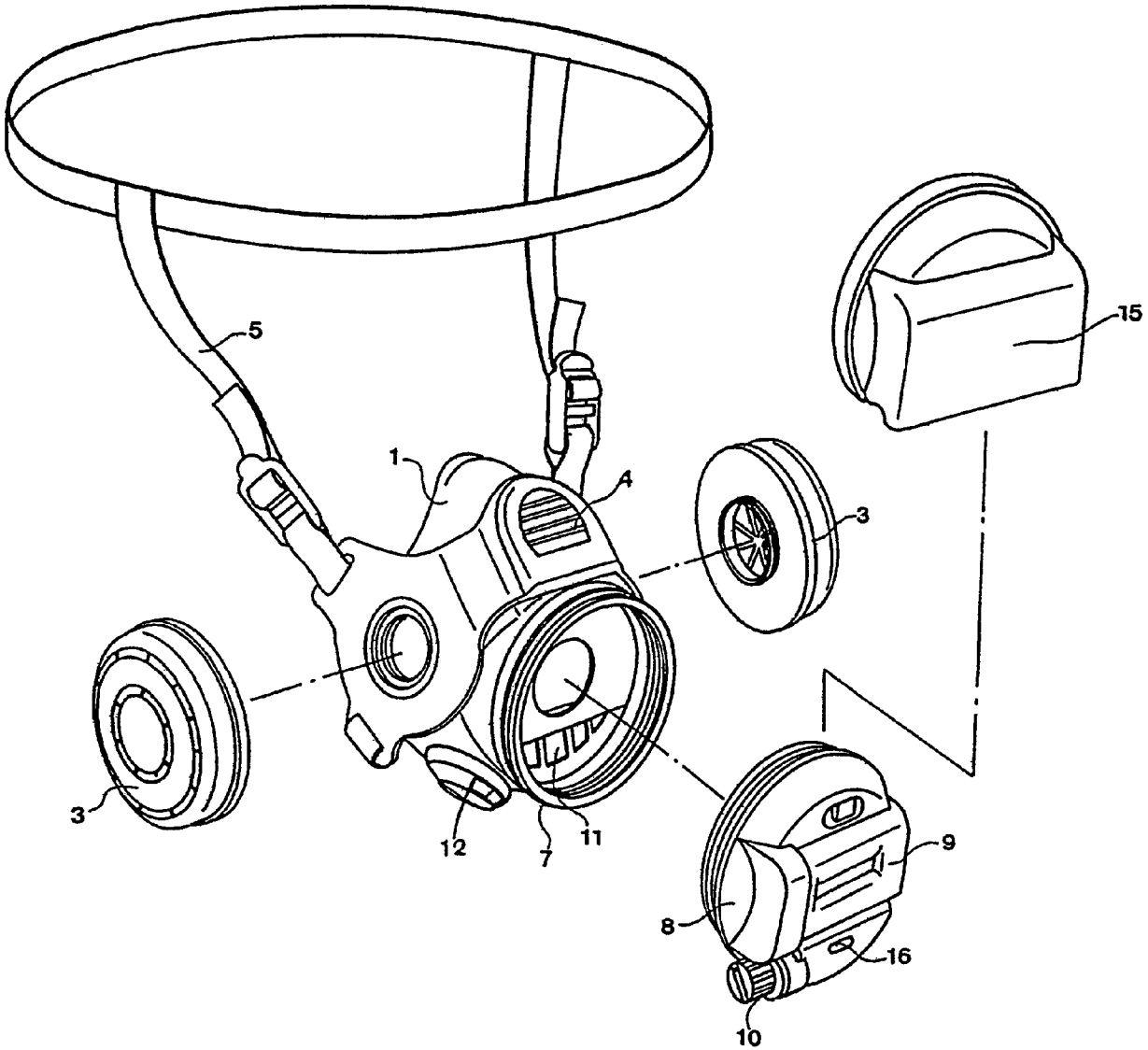

FIG. 2: Perspective view showing that the powered respirator of the present invention is exploded to each part.

Figure 3:
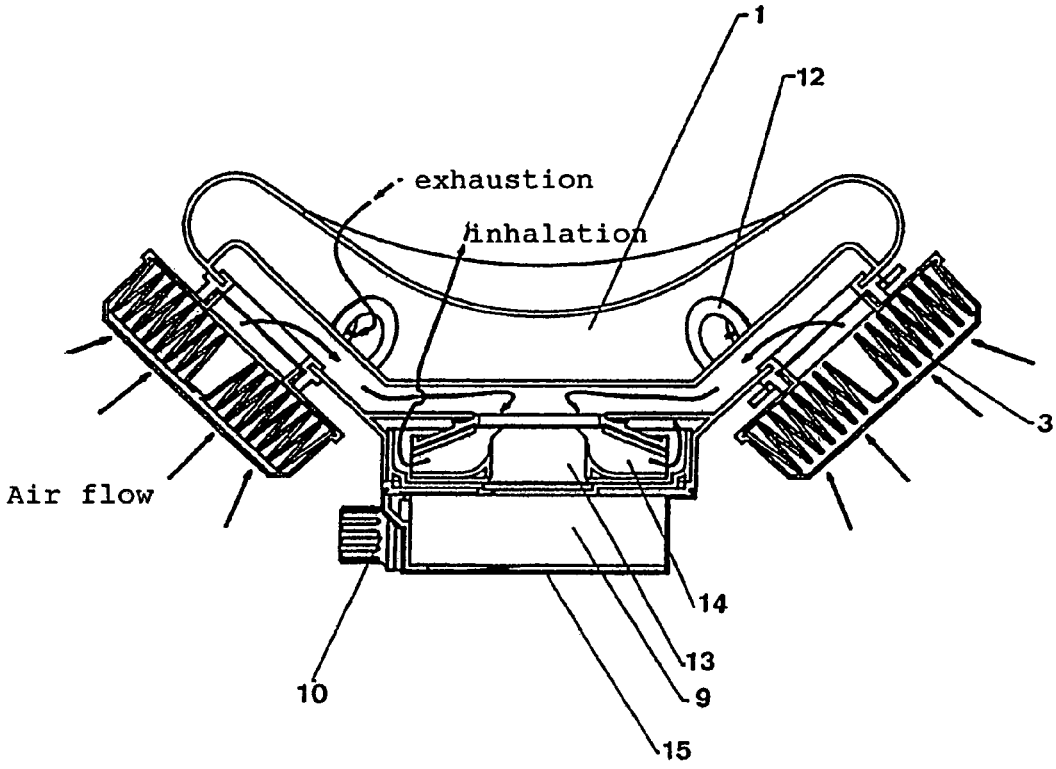

FIG. 3: Cross sectional view of the powered respirator of the present invention.

Illustration of Marks

1: face piece part 2: air supplying unit 3: filter
4: voice tube 5: fastening string 6: helmet
7: face piece side part of air supplying unit
8: battery holding side part of air supplying unit
9: battery 10: power supply switch 11: inhalation valve
12: exhaust valve 13: motor 14: electric fan
15: battery cover

DETAIL DESCRIPTION OF THE INVENTION

The present invention will be illustrated in more detail.

The face piece part of the present invention can be a whole surface face piece part covering whole face of a user, or can be a half surface face piece part covering nose and mouth of a user, and a part which contacts with the face, forms a dual structure composed of an elastic material such as silicone rubber or nitrile rubber. At the surface side of the powered respirator of the present invention, a filter, an air release valve and a fastening string are equipped, and these structural features are similar to a conventional powered respirator. The important point of the present invention is that the powered respirator of the present invention is further equipped an air supplying unit. The reverse surface side of the powered respirator of the present invention, forms a face contacting part characterizing to wrap a face, and a material can be same as to that of the surface side. And when constructed by a slightly thinner material than that of the surface side, wearing stability is improved and is desirable. The air releasing valve can be same as to the air releasing valve used in the conventional powered respirator, and releases excess clean air supplied from the air supplying unit and expiration.

Further, it is desirable to provide a voice tube to the face piece part which makes possible to converse with a person outside. Further, supposing the use together with a helmet, it is desirable to equip a fastening string, and a structure to support a wide width fastening string by a brim of helmet promises further improvement of wearing stability.

To the air supplying unit, an electric fan, a motor and a battery are built in by forming one body, and the surface of battery is covered by a battery cover composed of hard synthetic resin so as to protect falling down of the battery. And a power supply switch, which also acts as an air flow adjusting knob, is equipped. By turning the switch, the electric fan is actuated, and by further turning the switch the volume of air flow is adjusted. Still further, it is desirable to equip a remaining capacity indicating lamp of battery and to indicate electric charge state of a battery.

EXAMPLE

The Example present invention will be illustrated more in detail according to drawings, however, not intending to limit the scope of the present invention. FIG. 1 is a perspective view showing the state that the powered respirator of the present invention is wear together with a helmet, and FIG. 2 is a perspective view showing that the powered respirator of the present invention is exploded to each part. In FIG. 1, in the center of a face piece part 1, which covers nose and mouth, a air supplying unit 2 comprising a battery 9 and a fan motor is equipped and a filter 3 is provided at the right and left parts. And on the upper part of the air supplying unit 2, which locates at the center part, a voice tube 4 is equipped so as to make the conversation with a parson of outside possible. At the both sides of the face piece part 1, a fastening string 5 is provided so as to support by a brim of helmet 6 which the user wears, thus the powered respiration of the present invention can be wear. FIG. 2 shows that in the air supplying unit 2, a part 7 which is installed to a face piece part 1 and a part 8 to hold a battery is fixed by a screw socket. At the center of the part 8 to install a battery, the battery 9 is installed and at down stream side, a power supply switch 10, which also acts as an air flow adjusting knob is equipped. And a motor and an electric fan are installed in inside of it. This part is shown in FIG. 3 which is the cross sectional view of the powered respiration of the present invention. In FIG. 3, at upper part and lower part of inside of the a part 7 which is installed to the air supplying unit 2 of the face piece part, an inhalation valve 11 which connects to the filter 3 equipped to the face piece part 1 is equipped, and an exhaust valve 12 which is opened from inside of the face piece part to outside is equipped. 15 shows a battery cover.

The air flow of the powered respiration of the present invention when the power supply switch 10 is on is indicated by arrow marks in FIG. 3. That is, the electric fan rotates and draws outside air, and the drawn outside air is cleaned by passing through a filter, then introduced into the face piece part by the inhalation valve 11. Therefore, the user can be always in the atmosphere of clean air. And expiration of the user and excess clean air are released from the exhaust valve 12 equipped to the outside of the face piece part.

INDUSTRIAL APPLICABILITY

Since the powered respiration of the present invention does not have an electric source cable or an air line hose, the powered respiration of the present invention is suited to be used as a dust proof mask or a gas mask at the place where dust or poisonous gas are generated such as factory or construction field.

What is claimed is:

1. A powered respirator, comprising an air supplying unit equipped to a center of a face piece part, which covers nose and mouth, said powered respirator and a filter equipped to the right and left positions of said face piece part, wherein an electric fan, a motor and a battery are contained within said air supplying unit and said air supplying unit is fixed by a screw socket to said face piece part, wherein an interior of the face piece part and the filters and the air supplying unit are fluidly connected together through a socket interior and transmit air from the filter through the socket interior to an inhalation valve which transmits said air to the interior of the face piece part.

2. The powered respirator of claim 1, wherein a voice tube is installed at an upper position of the air supplying unit located at the center of the face piece part.

3. The powered respirator of claim 1, further comprising a cover securing the battery to the air supplying unit separate from said filters.

4. The powered respirator of claim 1, further comprising a fastening member supporting said face piece part on a user.

5. A powered respirator for use over a face of a user, comprising:

a face piece, said face piece having a centrally positioned screw socket and a first filter attachment point which is positioned to a side of the face piece and fluidly communicates with said socket;

a filter mounted to the first filter attachment point; and an air supplying unit mounted to the screw socket so as to be centrally positioned on the face piece, the air supplying unit comprising a self-contained unit enclosing a fan, an electric motor and a battery, wherein the socket receives air from said filter and the interior of the face piece and the filter and the air supplying unit are fluidly connected by an inhalation valve in the socket, and wherein said air supplying unit draws air from an exterior of said face piece through said filter sidewardly through a portion of said face piece to said socket and pushes said air out to an interior of said face piece.

6. The powered respirator of claim 5, further comprising a second filter attachment point positioned to a side of the face piece opposite the first filter attachment point wherein said second filter attachment point includes a respective said filter thereon and said fan draws air sidewardly from both of said filters to said socket.

7. The powered respirator of claim 5, further comprising a battery cover mounted to said air supplying unit separate from said filters.

8. The powered respirator of claim 5, wherein at least one exhaust valve is disposed in said face piece below said socket to permit exhaled air from the user to be exhausted from the interior of the face piece, through the face piece to the exterior of the face piece.

9. The powered respirator of claim 5, wherein the air is drawn sidewardly from said filter to the socket, forwardly through said fan and then it flows rearwardly out of said socket through an inhalation valve in said socket to the interior of the face piece.

10. A powered respirator for use over a face of a user comprising:

a face piece, said face piece having a centrally positioned screw socket, a first filter attachment point which is formed on a side of the face piece and a channel formed within said face piece, wherein the channel fluidly communicates between said socket and said first filter attachment point;

a filter mounted to said first filter attachment point;

an air supplying unit mounted to the screw socket so as to be centrally positioned on the face piece, the air supplying unit comprising a self-contained unit enclosing a fan, an electric motor and a battery, wherein said air supplying unit draws air from an exterior of said face piece through said filter, sidewardly through said channel to said socket and pushes said air out to an interior of said face piece; and a voice tube centrally mounted in the face piece adjacent the air supplying unit.

11. The powered respirator of claim 10, wherein the voice tube is mounted in the face piece above the air supplying unit.

12. The powered respirator of claim 10, wherein the voice tube is mounted and functions independently of the air supplying unit and filter.

13. The powered respirator of claim 10, further comprising a second filter attachment point positioned to a side of the face piece opposite the first filter attachment point, said second filter attachment point including a respective filter mounted thereon.

14. The powered respirator of claim 10, further comprising a battery cover mounted to said air supplying unit separate from said filters.

15. The powered respirator of claim 10, wherein the socket receives air from said filter through said channel, and the interior of the face piece and the air supplying unit are fluidly connected by an inhalation valve in the socket.

16. The power respirator of claim 10, further comprising a second filter attachment point positioned to a side of the face piece opposite the first filter attachment point, wherein said second filter attachment point includes a respective said filter thereon and said fan draws air sidewardly from both of said filters through said channel to said socket.

* * * * *